US011648568B2

(12) United States Patent
VanFleet et al.

(10) Patent No.: US 11,648,568 B2
(45) Date of Patent: May 16, 2023

(54) SPRAY BOTTLE—BLENDER ASSEMBLY

(71) Applicants: Kyle Demetrius VanFleet, Lebanon, NJ (US); James VanFleet, Palmyra, PA (US)

(72) Inventors: Kyle Demetrius VanFleet, Lebanon, NJ (US); James VanFleet, Palmyra, PA (US)

( * ) Notice: Subject to any disclaimer, the term of this patent is extended or adjusted under 35 U.S.C. 154(b) by 0 days.

(21) Appl. No.: 17/659,871

(22) Filed: Apr. 20, 2022

(65) Prior Publication Data

US 2022/0339638 A1 Oct. 27, 2022

Related U.S. Application Data

(60) Provisional application No. 63/201,269, filed on Apr. 21, 2021.

(51) Int. Cl.

| | |
|---|---|
| ***B05B 11/00*** | (2023.01) |
| ***B02C 23/36*** | (2006.01) |
| ***B02C 18/12*** | (2006.01) |
| ***B02C 18/18*** | (2006.01) |
| ***B05B 11/10*** | (2023.01) |

(52) U.S. Cl.

CPC ..... *B02C 23/36* (2013.01); *B02C 18/12* (2013.01); *B02C 18/18* (2013.01); *B05B 11/1042* (2023.01)

(58) Field of Classification Search

CPC ..... B05B 11/1042; B05B 11/1057; B05B 11/1045; B05B 15/25; B05B 15/40; B05B 15/30; B05B 7/0043; B05B 7/0068; B02C 23/36; B02C 18/12; B02C 18/18

See application file for complete search history.

(56) References Cited

U.S. PATENT DOCUMENTS 2,959,358 A * 11/1960 Vork ..... B05B 7/12 137/98
3,099,394 A * 7/1963 Lynn ..... A01C 23/042 239/378
3,672,645 A * 6/1972 Terrels ..... B05B 7/2408 366/250
4,184,778 A * 1/1980 Terrels ..... B01F 35/00 366/250
4,501,500 A * 2/1985 Terrels ..... B05B 15/25 366/250

(Continued)

*Primary Examiner* — Vishal Pancholi

(74) *Attorney, Agent, or Firm* — Dunlap Bennett & Ludwig, PLLC; Anna L. Kinney

(57) ABSTRACT

A handheld comminutor—spray bottle assembly includes a bottle; a comminutor; and a sprayer assembly. The bottle has an externally threaded mouth. The comminutor includes a comminutor body, with an internally threaded rim, housing a power source and an electrically connected motor. Blades connected to the motor by a shaft extend from the comminutor body. The sprayer assembly includes a spray head attached to a spray bottle cap, a siphon straw and an elongated filter housing connected with a spray head inlet, with a filter on the housing. A filter housing cap secures the filter to the housing. The spray bottle cap has an internally threaded rim and a seal ring. The comminutor rim and the spray bottle cap rim alternately connect with the mouth of the bottle. The motor rotates the shaft and the blades. Biomatter and liquid comminuted in the bottle are dispensed using the spray head.

8 Claims, 4 Drawing Sheets

(56) References Cited

U.S. PATENT DOCUMENTS

| | | | | |
|---|---|---|---|---|
| 5,461,814 | A | 10/1995 | Reid et al. | |
| 6,038,804 | A | 3/2000 | Cuerrier | |
| 6,357,673 | B1 * | 3/2002 | Condon | B05B 9/0822 239/378 |
| 6,395,170 | B1 * | 5/2002 | Hughes | B01D 35/02 222/189.1 |
| 7,708,170 | B2 * | 5/2010 | Kelly | B05B 11/0081 222/464.2 |
| 8,490,889 | B2 | 7/2013 | Rydbom | |
| 8,613,402 | B2 | 12/2013 | Lefkovitz | |
| 8,657,162 | B2 * | 2/2014 | Kelly | B67D 7/58 222/464.2 |
| 9,028,457 | B2 * | 5/2015 | Leach | A61M 1/02 604/289 |
| 9,426,977 | B1 | 8/2016 | Wynalda, Jr. | |
| 2004/0064995 | A1 | 4/2004 | Gilmore | |
| 2005/0246938 | A1 | 11/2005 | Windus | |
| 2007/0042012 | A1 | 2/2007 | Ambrose et al. | |
| 2008/0259722 | A1 | 10/2008 | Sanford | |
| 2009/0050711 | A1 | 2/2009 | Castner | |
| 2010/0112025 | A1 | 5/2010 | Farris et al. | |
| 2015/0060564 | A1 | 3/2015 | Bowles | |
| 2015/0136871 | A1 | 5/2015 | Burgeson | |
| 2018/0221523 | A1 | 8/2018 | Mallo, Jr. | |
| 2018/0279664 | A1 | 10/2018 | Shoham et al. | |

* cited by examiner

SPRAY BOTTLE—BLENDER ASSEMBLY

CROSS-REFERENCE TO RELATED APPLICATION

This application claims the benefit of priority of U.S. provisional application No. 63/201,269, filed Apr. 21, 2021, the contents of which are herein incorporated by reference.

BACKGROUND OF THE INVENTION

The present invention relates to a device for preparing and applying custom blended products and, more particularly, to a spray bottle—blender assembly.

Consumers purchase spray bottles with pre-made products that have many ingredients sourced from natural elements and plant materials. Most of these spray solutions consist of ingredients that can be harvested from plant material by a consumer. The process is time consuming and multiple tools are required to harvest these elements for consumer use. Moreover, the shipping costs, both from a monetary and an environmental standpoint, are excessive to obtain the products. For example, outdoorsmen and women and hunters spend billions of dollars per year purchasing spray bottles with pre-made liquid cover scents. The currently available cover scents are generic scents, not specific to the hunter's exact surroundings.

As can be seen, there is a need for an inexpensive, portable, customizable means of preparing a naturally based spray solution, such as a cover scent.

SUMMARY OF THE INVENTION

The present invention provides a spray bottle—blender assembly that enables consumers to create their own natural spray solutions for a wide range of uses, at home or onsite, organically, and more cheaply than commercially available products. Moreover, the inventive spray bottle—blender assembly may be used to create aesthetically pleasing scents for the home or other surroundings. The spray bottle—blender assembly is believed to save individuals money in an eco-friendly way.

In one aspect of the present invention, a handheld comminutor—spray bottle assembly comprises a bottle body having an externally threaded mouth; a mating comminutor comprising a comminutor body having a first internally threaded rim, said comminutor body housing a power source and a motor electrically communicating with the power source, a shaft coupled to the motor, and comminutor blades joined to the shaft, extending from the comminutor body, and fluidly isolated from the motor; and a mating sprayer assembly, comprising a spray bottle cap having a second internally threaded rim and a seal ring; a spray bottle head having an inlet, an outlet, and an activation lever, said spray bottle head being joined with the spray bottle cap, a siphon straw coupled with the inlet and an elongated filter housing threadedly coupled with the inlet around the siphon straw, and a filter housed around the filter housing and removably secured with a filter housing cap secures a filter to the filter housing. The first internally threaded rim is couplable with the externally threaded mouth of the bottle body and the motor is operative to rotate the shaft, thereby rotating the comminutor blades. The second internally threaded rim is couplable with the externally threaded mouth of the bottle body.

In another aspect of the present invention, a method of producing a scent composition comprises containing biomatter with a diluent liquid in a bottle in an upright position; coupling the bottle with a comminuting chamber; inverting the bottle coupled with the comminuting chamber; comminuting said biomatter in said diluent liquid to produce a scent composition; returning the bottle to an upright position; decoupling the comminuting chamber from the bottle; coupling the bottle with a scent dispenser comprising a sprayer head having a siphon straw with a filter, a lever, and an outlet; and actuating the lever to dispense the scent composition through the outlet.

These and other features, aspects and advantages of the present invention will become better understood with reference to the following drawings, description, and claims.

DETAILED DESCRIPTION OF THE INVENTION

Figure 1:
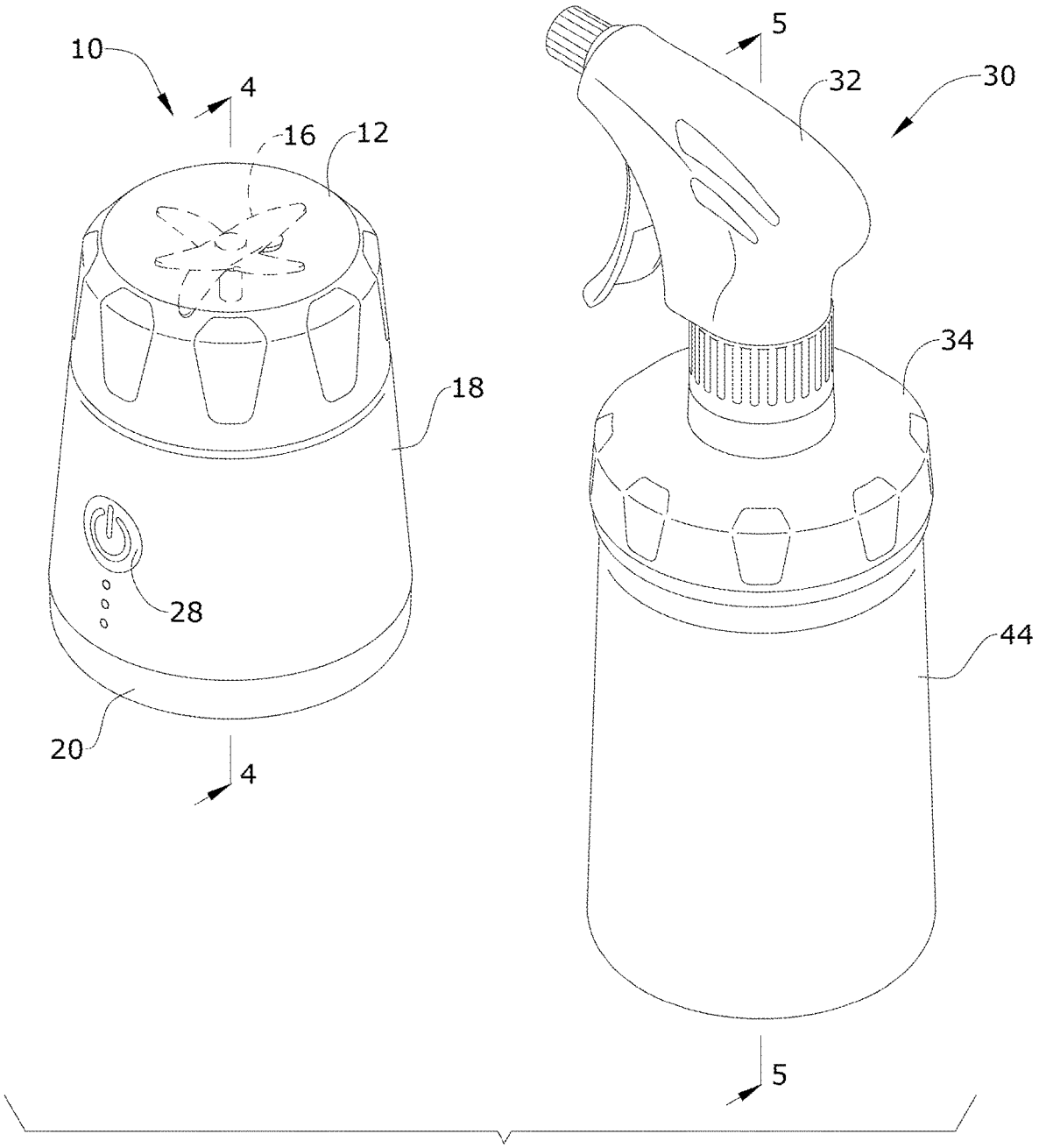
FIG. 1 is a perspective view of a grinder and spray bottle assembly according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The terms "blender", "grinder", and "comminutor" are used interchangeably herein to refer to an apparatus that comminutes biomatter in a diluent liquid using blades.

Broadly, one embodiment of the present invention is a combined handheld blender—spray bottle assembly.

In some embodiments, the inventive assembly may include the blender or grinder, the bottle body, and the spray head, detachably combined into a single device.

In some embodiments, the bottle body may be alternately assembled with the blender or the spray head, according to use. A hunter may prepare the cover scent before leaving the car and carry the spray bottle without the blender component.

In some embodiments, capsules containing pre-formulated scents may be placed in the bottle.

The inventive assembly may have a variety of uses, including but not limited to production and application of insect repellent, animal repellants, foliar plant sprays, skin care compositions, scent sprays, cooking compositions, cleaning products, fungicides, bactericides, and combinations thereof.

A method of using the spray bottle—blender assembly may include the following. The user may pick local leaves, flowers, and other elements, and place them into the plastic bottle with water. The user may attach the blender to the bottle and blend the ingredients. Once the ingredients are blended, the user may detach the blender and carry the bottle with the spray top attached to spray themselves and surroundings with self-made scent. The self-made scent masks a non-locally sourced scent, such as the user's cleansers and body odor.

The materials of manufacture and the dimensions are not particularly limited. For example, the assembly may include a small heavy-duty plastic bottle, spray head, and siphon straw. The assembly may also include a small handheld blender, such as a single cup measure.

Referring to FIGS. 1 through 6, FIG. 1 illustrates a grinder assembly 10 and spray bottle assembly 30 according to an embodiment of the present invention. The grinder assembly 10 includes a circular grinder base 20 and a substantially cylindrical grinder body 18. Indicator lights on the grinder body 18 surface may indicate the grinder assembly 10 status. The grinder assembly 10 may include a grinder cap 12 to protect the grinder blades 16 when the grinder assembly 10 is stored or transported. The spray bottle assembly 30 includes a substantially cylindrical bottle 44 attached via a spray bottle cap 34 to a spray bottle head 32. The grinder cap 12 and the spray bottle cap 34 both may have a substantially circular shape with grasp indents to improve grip.

Figure 2:
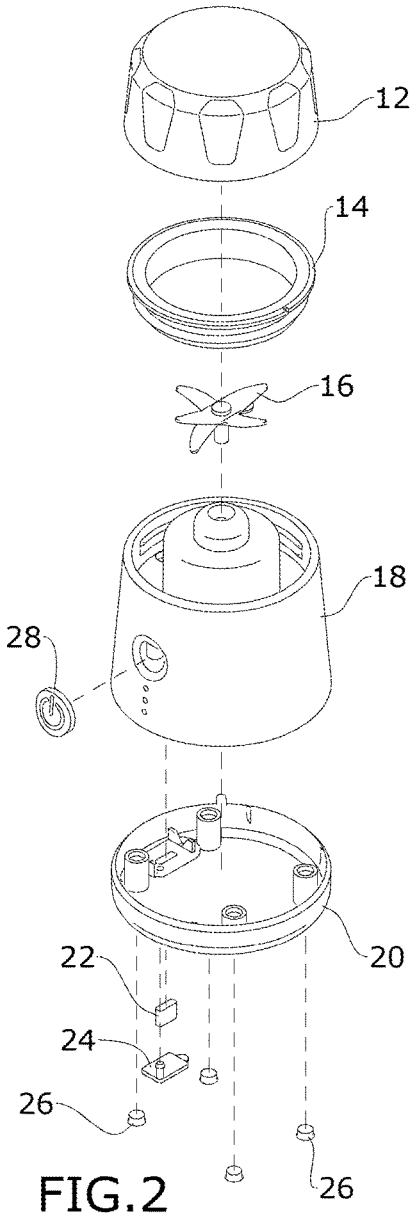
FIG. 2 is an exploded view of the grinder assembly thereof.
Figure 4:
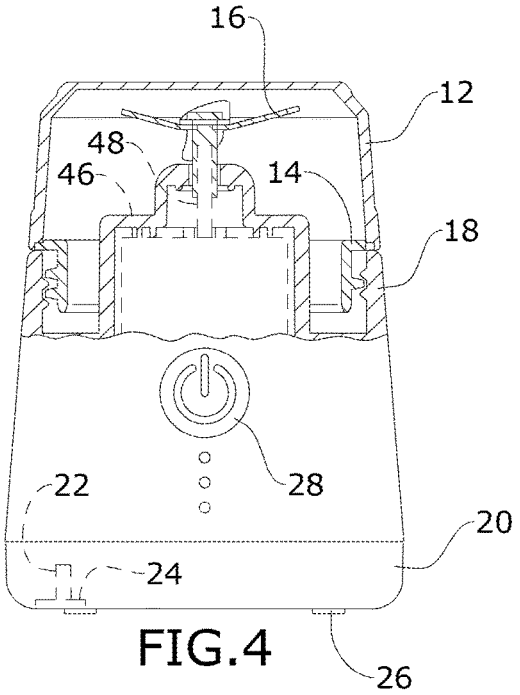
FIG. 4 is a sectional view taken along 4-4 in FIG. 1.

As shown in FIGS. 2 and 4, the grinder body 18 contains a motor 46 operative to drive the grinder blades 16 via a shaft 48 when the grinder assembly 10 is actuated via a power button 28 actuator. The power button 28 controls delivery of power from a power source to the motor 46. The grinder assembly 10 may be powered by way of a Universal Serial Bus (USB) port 22 having a USB cover 24 to protect the port 22. The grinder body includes protective grinder base pads 26 upon which it rests. The grinder cap 12 further comprises a grinder adapter ring 14, which may be produced as a unitary molded piece.

Figure 3:
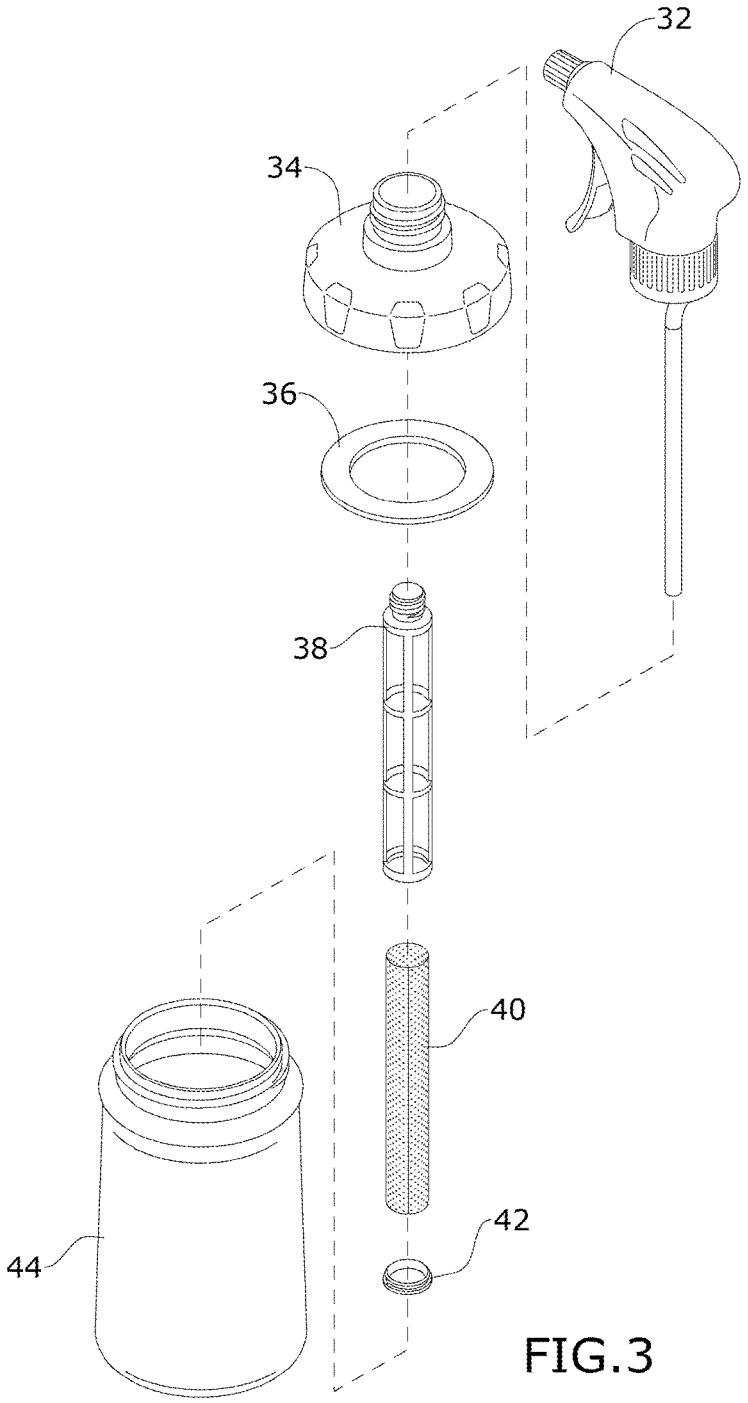
FIG. 3 is an exploded view of the spray bottle assembly thereof.
Figure 5:
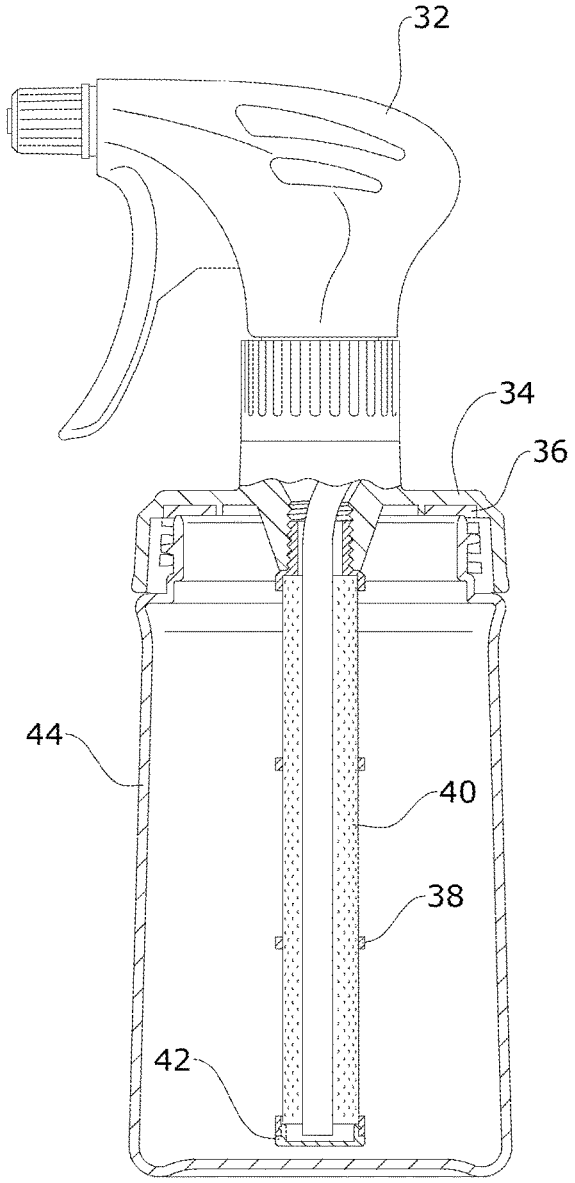
FIG. 5 is a sectional view taken along 5-5 in FIG. 1.
Figure 6:
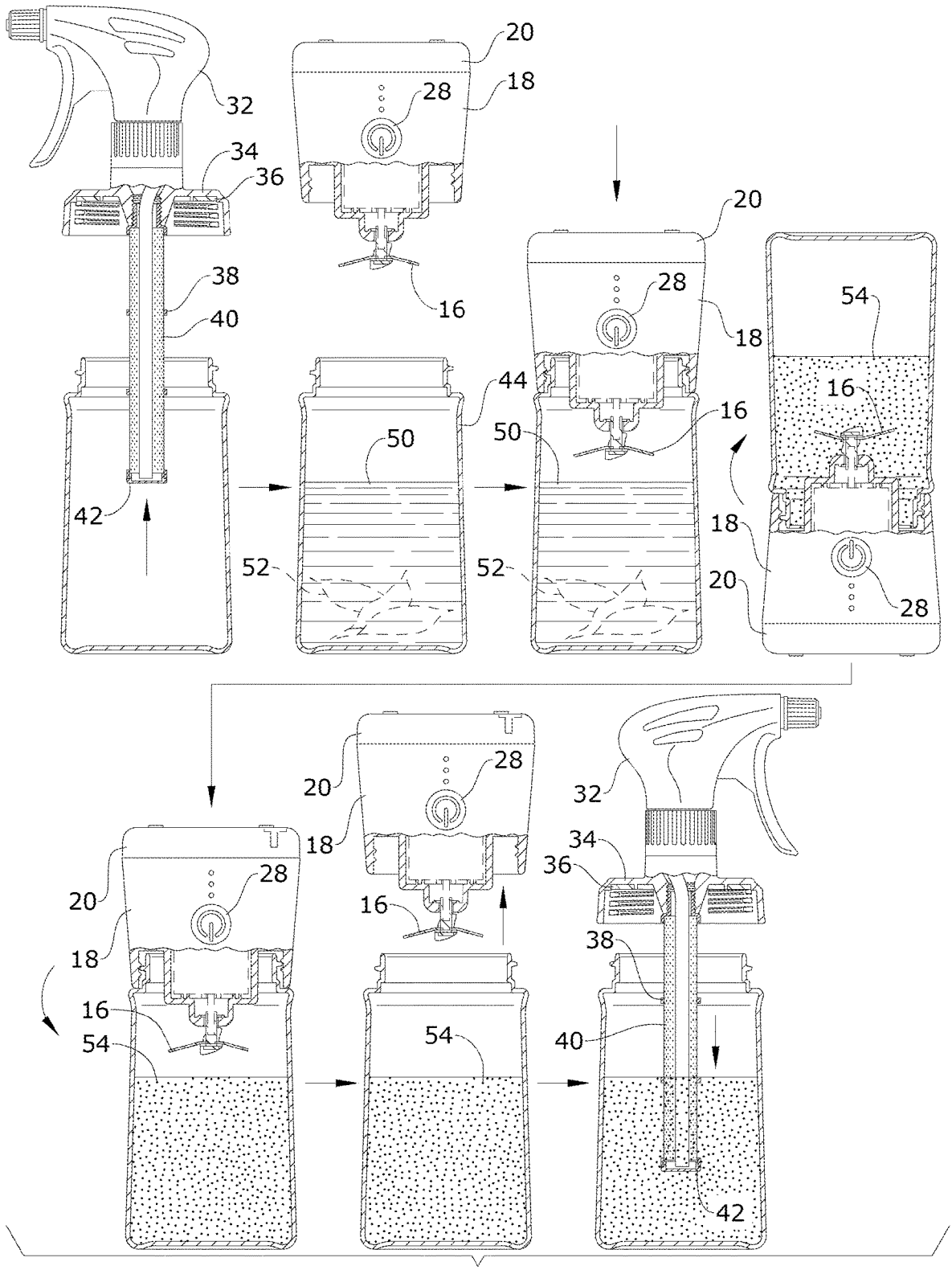
FIG. 6 is a schematic view thereof, showing the grinder assembly being removed and the spray head attached.

FIGS. 3 and 5 illustrate components of the spray bottle assembly 30. The spray bottle cap 34 has a spray bottle ring 36 to provide a seal with the bottle 44, as shown in FIG. 6. The spray bottle cap 34 threadedly couples with the spray bottle head 32 on an upper surface and with an elongated filter housing 38 on a lower surface. A filter housing cap 42 secures a filter 40 to the filter housing 38. A straw coupled to the spray bottle head 32 extends longitudinally into the bottle 44 within the filter housing 38.

As shown in FIG. 6, liquid 50 and environmental elements 52 may be placed within the bottle 44. The bottle 44 threadedly couples with the grinder body 18. The assembly may be inverted so that the liquid 50 submerges the blades 16. Once the grinder assembly 10 is actuated, the environmental elements 52 are blended into the liquid 50 to produce a blended scent 54. The bottle 44 may be returned to its upright position and the grinder assembly 10 may be detached. The spray bottle cap 34 threadedly couples with a mouth of the bottle 44. Once the spray bottle cap 34 is installed, the filter 40 and straw may be submerged within the blended scent 54. The blended scent 54 may be sprayed by actuating a lever actuator on the spray bottle head 32.

It should be understood, of course, that the foregoing relates to exemplary embodiments of the invention and that modifications may be made without departing from the spirit and scope of the invention as set forth in the following claims.

What is claimed is:

1. A handheld comminutor—spray bottle assembly, comprising:

a bottle body having an externally threaded mouth;

a mating comminutor comprising a comminutor body having a first internally threaded rim, said comminutor body housing a power source and a motor electrically communicating with the power source, a shaft coupled to the motor, and comminutor blades joined to the shaft, extending from the comminutor body, and fluidly isolated from the motor, wherein the first internally threaded rim is couplable with the externally threaded mouth of the bottle body and the motor is operative to rotate the shaft, thereby rotating the comminutor blades; and a mating sprayer assembly, comprising a spray bottle cap having a second internally threaded rim and a seal ring, a spray bottle head having an inlet, an outlet, and an activation lever, said spray bottle head being joined with the spray bottle cap, a siphon straw coupled with the inlet and an elongated filter housing threadedly coupled with the inlet around the siphon straw, and a filter housed around the filter housing and removably secured with a filter housing cap secures the filter to the filter housing, wherein the second internally threaded rim is couplable with the externally threaded mouth of the bottle body.

2. The handheld comminutor—spray bottle assembly of claim 1, further comprising a threaded comminutor cap with grasp indents.

3. The handheld comminutor—spray bottle assembly of claim 1, wherein the power source comprises a USB port.

4. The handheld comminutor—spray bottle assembly of claim 1, further comprising an actuator that controls delivery of power from the power source to the motor.

5. The handheld comminutor—spray bottle assembly of claim 1, further comprising base pads extending from the comminutor body.

6. The handheld comminutor—spray bottle assembly of claim 1, wherein the spray bottle cap has grasp indents.

7. A method of producing and dispensing a natural spray composition, comprising:

containing biomatter with a diluent liquid in a bottle in an upright position;

coupling the bottle with a comminuting chamber, inverting the bottle coupled with the comminuting chamber;

comminuting said biomatter in said diluent liquid to produce the natural spray composition;

returning the bottle to the upright position;

decoupling the comminuting chamber from the bottle;

coupling the bottle with a spray dispenser comprising a sprayer head having a siphon straw with a filter, a lever, and an outlet; and actuating the lever to dispense the natural spray composition through the outlet.

8. The method of claim 7, further comprising sourcing the biomatter locally such that the natural spray composition masks a non-locally sourced scent.

* * * * *